United States Patent [19]

Rugroden

[11] 4,254,598

[45] Mar. 10, 1981

[54] THERMALLY ISOLATED ROOF STRUCTURE

[76] Inventor: Roger R. Rugroden, 2194 Reaney St., St. Paul, Minn. 55119

[21] Appl. No.: 40,583

[22] Filed: May 21, 1979

[51] Int. Cl.[3] ..... E04B 7/00

[52] U.S. Cl. ..... 52/199; 52/95

[58] Field of Search ..... 52/95, 199, 22, 303, 52/305

[56] References Cited

U.S. PATENT DOCUMENTS

| | | | |
|---|---|---|---|
| 1,150,133 | 8/1915 | Lester | 52/22 |
| 3,006,113 | 10/1961 | Barnes et al. | 52/95 X |
| 3,313,072 | 4/1967 | Cue | 52/303 |
| 3,318,056 | 5/1967 | Thompson | 52/303 X |
| 3,797,180 | 3/1974 | Grange | 52/199 X |

FOREIGN PATENT DOCUMENTS

| | | | |
|---|---|---|---|
| 2353366 | 5/1975 | Fed. Rep. of Germany | 52/95 |
| 2716925 | 10/1978 | Fed. Rep. of Germany | 52/22 |

*Primary Examiner*—Price C. Faw, Jr.
*Assistant Examiner*—Carl D. Friedman
*Attorney, Agent, or Firm*—Neil B. Schulte

[57] ABSTRACT

A corrugated panel adapted to be nailed to a roof between the base roof structure and the roof covering material so as to provide a multitude of ventilating air passages under the roof covering and thermally isolate the roof covering from the building.

4 Claims, 3 Drawing Figures

THERMALLY ISOLATED ROOF STRUCTURE

BACKGROUND OF THE INVENTION

The most common type of roof construction in use today involves a slanted roof positioned over a building such as a house which roof extends beyond the edges of the building to form eaves and rake projections. In the winter heat rises from within the house and melts snow on the top surface. The water therefrom runs down the slanted roof to the eave portion which is not heated and refreezes forming ice dams that are dangerously heavy and destructive to the structure. In addition, the dams back up water under the shingles causing leaks and deterioration.

In the prior art this problem has been approached by attempting to insulate the roof covering better. However, this approach can never be fully successful because no matter how much insulation is utilized the internal heat eventually leaks through by conduction to the outside surface during the course of the winter and creates melting conditions. It is necessary that an absolutely cold roof surface be created and maintained irrespective of the heat flow from inside the building.

One prior art approach described in U.S. Pat. No. 4,023,321 employs shingles having tiny air passages formed in the shingle to allow ventilating air from the outside to isolate the top surface of the shingle. However, these air passages are so small that not much air can be expected to pass through and they are soon clogged with dirt and moisture. In addition, the shingle actually has more solid area than ventilating area and thus the heat can still conduct through in the spaces between and beside the tiny air passages. Also, since the entrance and exit ends of the ventilating passageways are at the same height there can be no draft effect to encourage the passage of air. My invention overcomes these problems.

BRIEF SUMMARY OF THE INVENTION

In brief, the present invention contemplates the use of corrugated panels which are nailed to the slanted roof with the corrugations running up and down the roof structure. A suitable roof covering material such as shingles, metal, roll roofing, or wood is nailed to the top of the panels to create numerous good sized passageways between the substructure and the roof covering material. The corrugated panel provides passageways which are opened at the lower edge of the roof and at the top peak of the roof thus, any heat that leaks through from the structure warms the passageway causing a draft therethrough. The warm air rises up and out at the peak of the roof drawing in outside cold air at the bottom. This maintains the top surface of the roof at the outside air temperature so that any melting that takes place on the surface is due to the ambient conditions and takes place equally over the eaves.

In essence my invention allows the outermost roof covering to seek its own natural temperature and not be influenced by an unnatural heat source from underneath. This design also prevents the torrid sun rays from heating the roof substratum thereby causing unwanted heat to penetrate into the living area during the hotter summer months. When the outermost roof covering is continuously allowed to seek and maintain, as nearly as possible, the ambient temperature it can duplicate nature in its fullest aspect thereby accomodating normal snow melting, wind action that activates blow-offs, sublimation, evaporation, and a generally orderly free-flowing dissipation of the snow such as occurs in nature. At the very beginning of the winter snow fall, the snow is less apt to stick to the roof shell and begin a build-up because of partially melted snow which starts a base for subsequent snow layers.

These inventive corrugated panels are relatively inexpensive as compared to the prior art shingles described above or other such systems. In addition, they can be nailed to the roof very quickly requiring a minimum of labor. It may therefore be seen that it is an object of my invention to provide an improved roof structure which maintains the top surface of the roof exactly at the outside ambient air temperature with a minimum of expense and complication. Further objects and advantages will become apparent from the following detailed description and drawings.

DESCRIPTION OF THE PREFERRED EMBODIMENT

Figure 1:
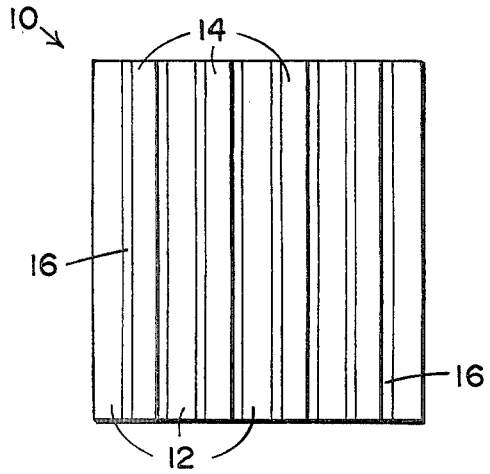
FIG. 1 shows a typical corrugated panel of the type contemplated by my invention.

In FIG. 1 a panel 10 is shown in accordance with the present invention. Panel 10 may be constructed from any nailable material such as polystrene or similar plastics, metal, or wood. In the preferred embodiment, a compressed wood fiber and resin binder composition board is used due to its easy forming characteristics, low cost, and long life in service.

Panel 10 is corrugated to provide a plurality of elongate strips 12 which can be fastened to the roof structure by nailing, screwing, or gluing. Suitable risers 16 connect strips 12 to a plurality of elongate strips 14 upon which the roof covering material 20 may be fastened.

Figure 2:
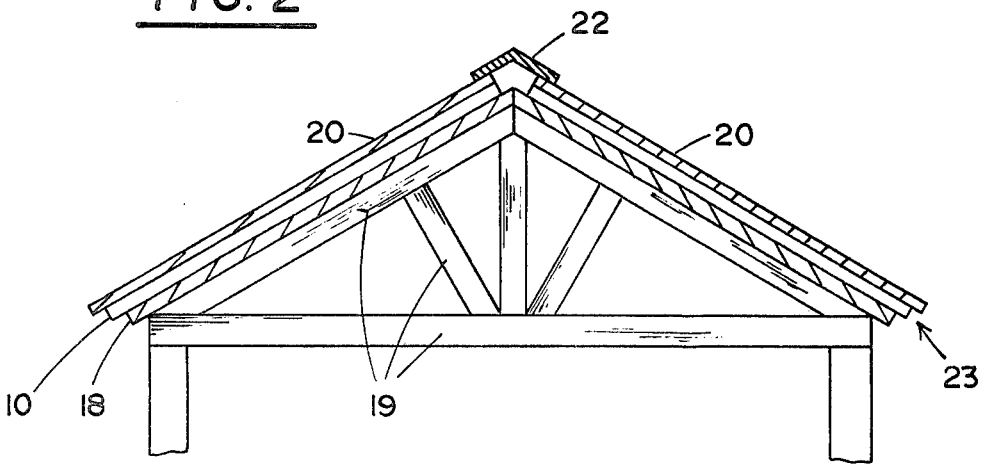
FIG. 2 is a cross sectional view of a structure showing how the panels would be applied to the roof.

In FIG. 2 a building structure is schematically shown with typical framing members 19 and a roof substructure 18 which forms a base for panels 10. The panels 10 are fastened to the base structure 18 with the corrugations extending up the roof so that the resultant passageways open at the eaves in the position designated by the numeral 23 and at the peak of the roof under a suitable rain cap 22. Accordingly, any heat energy which seeps through the insulation of the building warms the passageways between risers 16 and causes an immediate circulation of ventilating air up the length of the roof. The warm air is exhausted from vent cap 22 while cool air is drawn in at the eaves location 23. This keeps the roof covering structure 20 exactly at the ambient air temperature. Thus, roof 20 is cold in the winter and warm in the summer, and is always completely independent from the temperature of the base structure 18.

Figure 3:
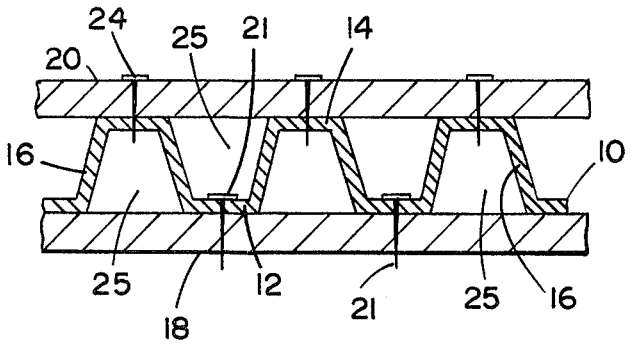
FIG. 3 is a cross sectional view of the roof structure and panel combined to show the passageways created therein.

The cross sectional view of FIG. 3 shows panel 10 securely fastened to base structure 18, in this case by nails 21, and roof covering structure 20 fastened to elongate strips 14 by suitable means, in this case nails 24. The only physical contact between the roof structure 20 and base 18 are the risers 16 which are very thin in comparison to the overall area and thus provide an extremely small conduction path. Furthermore, risers 16 are subjected to cooling air so that any thermal energy in them is dissipated before it can reach the opposite side of the panel. However, panel 10, because of its shape, is structurally quite strong and it is still possible for persons to walk on the roof without danger of crushing the ventilating passageways. This is important in northern climates, where the invention is most useful, due to the heavy snow loads that often accumulate on the roof structures. It should also be noted in FIG. 3 that ventilating air passages 25 are provided on both sides of risers 16 to ensure the removal of any thermal energy which is conducted through riser 16. In consequence, the roof structure 20 can be said to be totally thermally isolated from the base structure 18 which means the roof covering will remain cold in winter and ice dams will never form.

Additional advantages may be noted with respect to my invention as shown in FIG. 3. The size and spacing of the strips 12 and 14 permit the use of a conventional nailing pattern as normally used with roofing. Also panels 10 provide acoustical isolation, thus, keeping external noise from sources such as rain, wind, hail, and airplanes out of the structure.

I claim:

1. A ventilated roof structure for maintaining the outside surface of the roof of a building at the ambient outside temperature irrespective of the heat flow through the roof of the building comprising in combination:

a base structure forming at least one generally plane surface over the roof area of a building;

a corrugated insulating panel supported on and fastened to said base structure and constructed from a material of sufficient strength and thickness to support a roof covering structure thereover and to hold nails driven therein, said corrugated panel having a plurality of generally parallel base structure engaging first elongate strips adapted to be fastened to said base structure, said first strips connected along their elongate edges to riser strips which riser strips connect at their edges opposite from said first strips to second elongate strips, which second elongate strips comprise a plurality of generally parallel roof covering engaging strips positioned alternately with said first strips so as to comprise a panel having ventilating air passages parallel to said strips and between said riser strips both above said first strips and below said second strips; and roof covering structure fastened only to said second elongate strips.

2. The structure of claim 1 in which said base structure is inclined from level with said panels fastened in position to have said ventilating air passages also inclined with their lower ends open at the lower edge of the roof and their upper ends open at the upper edge of the roof so as to create a draft circulation through said ventilating air passages, the upper ends of said ventilating passages covered by a suitable vent cap to prevent entry of water.

3. The structure of claim 2 in which said panels are formed from a wood fiber and binder composition board.

4. The structure of claim 2 in which said panels are formed from a plastic.

* * * * *